United States Patent [19]

Chiaramonte

[11] Patent Number: 4,718,581

[45] Date of Patent: Jan. 12, 1988

[54] GARMENT HANGER

[76] Inventor: Fran Chiaramonte, 212 Dorothy St., Scottdale, Pa. 15683

[21] Appl. No.: 1,519

[22] Filed: Jan. 8, 1987

[51] Int. Cl.[4] ..... A41D 27/22

[52] U.S. Cl. ..... 223/96; 223/95

[58] Field of Search ..... 223/96, 95, 90, 91, 223/DIG. 2

[56] References Cited

U.S. PATENT DOCUMENTS

| | | | |
|---|---|---|---|
| 1,447,083 | 2/1923 | Jonas | 223/96 |
| 2,473,408 | 6/1949 | Alkin | 223/96 |
| 3,070,270 | 12/1962 | Campagnolo | 223/95 |
| 3,896,980 | 7/1975 | Campagnolo | 223/95 |
| 3,946,915 | 3/1976 | Crane | 223/96 |
| 3,950,829 | 4/1976 | Cohen | 223/96 X |
| 4,010,879 | 3/1977 | George et al. | 223/96 |
| 4,395,799 | 8/1983 | Batts | 223/96 X |

*Primary Examiner*—Louis K. Rimrodt
*Assistant Examiner*—J. L. Olds
*Attorney, Agent, or Firm*—Gilden & Israel

[57] ABSTRACT

A garment hanger is particularly designed for grasping the waistband of trousers. The hanger includes spaced apart clamps having serrated grasping jaws to effect a secure attachment between a hanger and the trousers. The jaws include the use of both rounded and pointed serrations.

1 Claim, 3 Drawing Figures

GARMENT HANGER

BACKGROUND OF THE INVENTION

1. Field of the Invention

The present invention relates to garment hangers, and more particularly pertains to new and improved garment hangers which utilize clamps having serrated edges so as to effectively grasp the waistbands of trousers.

2. Description of the Prior Art

The prior art is replete with examples of garment hangers designed to hold trousers and the like. A substantially large number of patents have issued directed to garment hangers particularly adapted for holding trousers, and most of these hangers rely upon the use of manually operable clamps to grasp the cuffs of the trousers. As is well known by those who utilize these prior art garment hangers on a frequent basis, such hangers are substantially ineffective for permanently retaining trousers in a secure manner. More specifically, trousers continually become disengaged from these hangers due to their ineffective designs.

A good example of a prior art garment hanger is to be found in U.S. Pat. No. 2,822,115, which issued to J. Cavanagh on Feb. 4, 1958. The Cavanagh hanger utilizes a pair of manually operable, spaced apart clamps designed to grip the cuffs of trousers. The clamps are smooth jawed so that the entire gripping force is provided by associated spring members. As these springs weaken, and depending upon the weight of the trousers hung on the hanger, it can be appreciated that the trousers can become easily disengaged.

A similar garment hanger is shown in U.S. Pat. No. 2,496,531 which issued to T. Gray on Feb. 7, 1950. The Gray garment hanger also utilizes spaced apart clamps which are of a smooth jawed construction with all gripping force being provided by associated spring members. As such, both the Gray garment hanger, as well as the above discussed Cavanagh garment hanger, are illustrative of a large number of further patents which could have been discussed and which relate directly to the same type of garment hanger construction.

There has been at least one attempt to manufacture a garment hanger which provides for the use of spaced apart clamps that operably grasp a garment in a more secure manner. In this respect, reference is made to U.S. Pat. No. 2,961,134, which issued to S. Ruzicka on Nov. 22, 1960. The Ruzicka garment hanger utilizes clamps having garment engaging faces which are serrated or otherwise roughened so as to more securely grip a garment. While being functional for its intended purpose, it can be appreciated that roughened or serrated clamp faces along will not sufficiently retain a pair of trousers over an extended period of time due to the weakening of the clamping springs and the attendant weight of the trousers.

As such, there appears to be a continuing need for new and improved garment hangers which will more securely grasp and retain the waistbands of trousers, and the like, wherein such trousers will not eventually slip free of such hangers, and in this respect, the present invention substantially fulfills this need.

SUMMARY OF THE INVENTION

In view of the foregoing disadvantages inherent in the known types of garment hangers now present in the prior art, the present invention provides an improved garment hanger which particularly designed for grasping the waistband of trousers, wherein such garment hanger utilizes clamps having both sharp and smooth tooth edges, thus to continually grasp such trousers irrespective of the strength of the associated clamping springs. As such, the general purpose of the present invention, which will be described subsequently in greater detail, is to provide a new and improved garment hanger which has all the advantages of the prior art garment hangers and none of the disadvantages.

To attain this, the present invention comprises two embodiments of a garment hanger which utilizes manually operable, spring biased clamps. In a first embodiment of the invention, the opposing jaw faces of the clamps are provided with sharp toothed edges which become firmly embedded within the waistband of trousers when the same are attached to the hanger. In this regard, one set of the tooth edges on a first jaw face may be partially rounded to limit damage to an exterior visible surface of the trousers, while the opposed jaw face tooth edges are sharpened to as to become embedded within the interiorly positioned waistband material. As such, as the spring clamping force weakens over an extended period of time, the sharp toothed face of the clamping jaws will still retain the trousers in an attached condition to the hanger.

A modified embodiment of the invention includes manually operable clamping members having opposed respective smooth and sharp tooth edges while external end portions of the clamps are also serrated or otherwise roughened to provide an even further gripping force against a trouser's waistband.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved garment hanger which hs all the advantages of the prior art garment hangers and none of the disadvantages.

It is another object of the present invention to provide a new and improved garment hanger which may be easily and efficiently manufactured and marketed.

It is a further object of the present invention to provide a new and improved garment hanger which is of a durable and reliable construction.

An even further object of the present invention is to provide a new and improved garment hanger which is susceptible of a low cost of manufacture with regard to both materials and labor, and which accordingly is then susceptible of low prices of sale to the consuming public, thereby making such garment hangers economically available to the buying public.

Still yet another object of the present invention is to provide a new and improved garment hanger which provides in the apparatuses and methods of the prior art some of the advantages thereof, while simultaneously overcoming some of the disadvantages normally associated therewith.

Still another object of the present invention is to provide a new and improved garment hanger which effectively and efficiently grasps the waistband of trousers without causing visible damage to the material.

Yet another object of the present invention is to provide a new and improved garment hanger which is particularly adapted for grasping the waistband of a pair of trousers.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
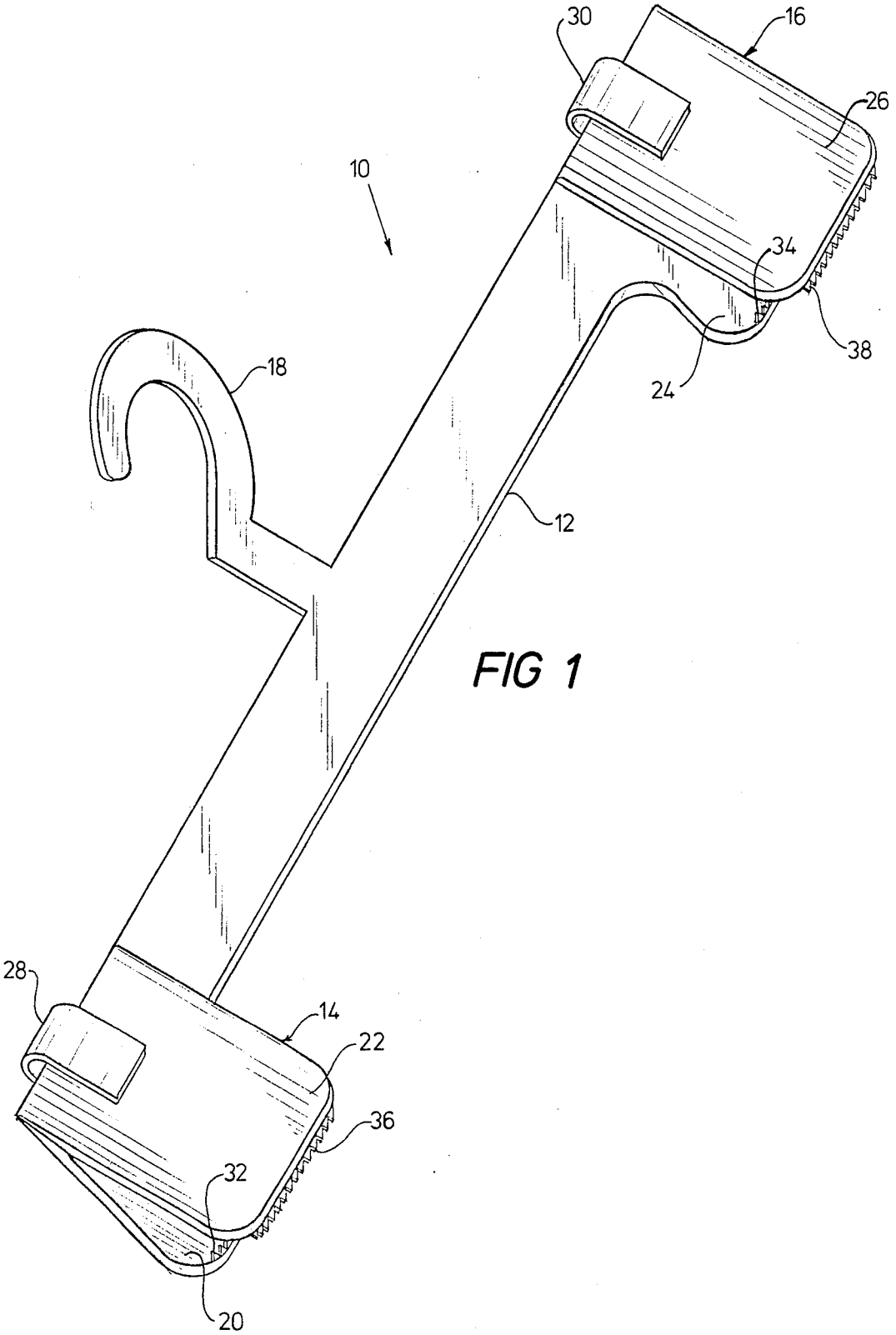
FIG. 1 is a perspective view of a first embodiment of a garment hanger comprising the present invention.

With reference now to the drawings, and in particular to FIG. 1 thereof, a first embodiment of a new and improved garment hanger embodying the principles and concepts of the present invention and generally designated by the reference numeral 10 will be described.

More specifically, it will be noted that the garment hanger 10 essentially comprises a conventional hanger structure 12 having a pair of spaced apart, spring operated clamps 14, 16 fixedly secured to opposed ends thereof. The hanger 12 further includes a conventional integral hook member 18 positionable over a clothes pole, or the like, and the entire structure may be formed from any conventional material, such as plastic or the like.

As illustrated, the clamp member 14 essentially comprises a first jaw face 20 which could be integrally a part of the hanger structure 12, and a relatively movable second jaw face 22. Similarly, the clamp member 16 includes a first jaw face 24 which is integrally a part of the hanger structure 12 and a relatively movable second face 26. Spring clamp 28 is utilized to attach the clamp section 22 to the clamp section 20, while a further spring clamp 30 facilitates the movable attachment of clamp member 26 to the clamp face 24.

Inasmuch as the clamp members 14, 16 are particularly designed for grasping the waistband of a pair of trousers, it can be appreciated that a first respective jaw face 20, 24 will come into engagement with an exterior visible surface of the trousers, while the second respective jaw faces 22, 26 will grasp an interior waistband portion of the trousers. Accordingly, the jaw faces 20, 24 are provided with respective inwardly directed serrated edges or teeth 32, 34. The teeth 32, 34 are provided with rounded edges and are designed to grasp the exterior visible material portion of the trouser waistband. In this regard, the rounded edges of the teeth 32, 34 will not do any visible damage to the exterior surface of the trousers while affording a means of grasping the same in a secure manner.

By the same token, the jaw faces 22, 26 are provided with inwardly directed respective sets of teeth 36, 38 with these teeth being designed to grasp the interior portion of a waistband. Additionally, the tooth sets 36, 38 are provided with sharpened or pointed edges so as to sink into the waistband material, thereby to effect a secure retention of the trousers to the garment hanger 10 irrespective of the clamping force provided by the springs 28, 30.

Figure 2:
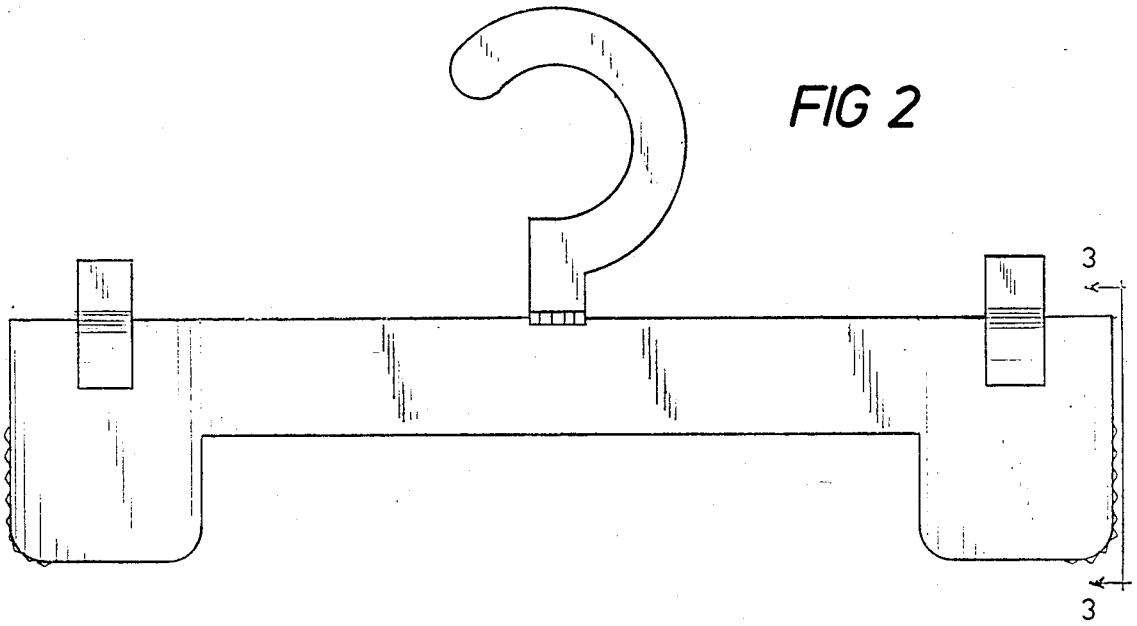
FIG. 2 is a front elevation view of a second embodiment of the invention.
Figure 3:
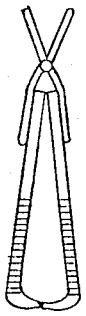
FIG. 3 is an end elevation view of the invention taken along the line 3—3 in FIG. 2.

FIGS. 2 and 3 of the drawings illustrate a modified embodiment of the garment hanger comprising the present invention with such modified embodiment being generally designated by the reference numeral 40. The modified embodiment 40 includes a conventional hook member 42 pivotally attached by a hinge member 44 to a pair of garment grasping members 46, 48. The members 46, 48 are held in an abutting engagement by conventional manually operable spring clamp members 50, 52. The member 46 is provided with inwardly directed sharpened teeth 54 at opposed ends thereof, and the member 48 is provided with similar inwardly directed grasping teeth 56 at opposed ends. Similar to the first embodiment of the invention, the tooth sets 54 are sharpened so as sink into an interior section of waistband material, while the tooth sets 56 are rounded so as to grasp an exterior portion of a trouser's waistband without any visible damage being caused to the material thereof.

Inasmuch as the waistband may extend outwardly beyond the edges of the garment hanger 40, opposed ends of the members 46, 48 are provided with respective roughened or serrated edges 58,60 so as to provide a further grasping force to a pair of trousers attached thereto. The serrated edges 58, 60 effectively comprise integral teeth having points directed upwardly. Since the upwardly directed points will grasp the interior waistbnd portion of the trousers, no visible damage to the exterior material surface of the trousers will occur.

As to the manner of usage and operation of the two embodiments of the invention, the same should be apparent from the above description. Accordingly, no further discussion relative to the manner of usage and operation of the invention will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A garment hanger for grasping the waistband of trousers of the like, comprising:

a. hanger means including support member means having hook means fixedly secured to an intermediate section thereof;

b. clamp means attached to said support member means and being operable to grippingly support said trousers;

c. serrated edge means forming a part of said clamp means, said serrated edge means including a first set of teeth frictionally engageable with an exterior portion of said trousers and a second set of teeth which penetrate an interior portion of waistband material of said trousers, said first set of teeth being provided with rounded points so as to prevent penetration of said first set of teeth into a material portioni of said trousers, said second set of teeth being provided with sharpened points to effectively cause a penetration of said second set of teeth into said waistband material, said first and second sets of teeth being held in an abuttable and relatively movable engagement by spring means; and, d. additional serrated edge means formed on end portions of said support member means, said additional serrated edge means including sharp pointed teeth for grasping said interior portion of said waistband material, said pointed teeth being directed upwardly with respect to a downward hanging direction of said trousers.

* * * * *